US007976088B1

(12) United States Patent
Diciolla

(10) Patent No.: US 7,976,088 B1
(45) Date of Patent: Jul. 12, 2011

(54) ROLL HOLDER

(76) Inventor: Daniel J. Diciolla, Dade City, FL (US)

( * ) Notice: Subject to any disclaimer, the term of this patent is extended or adjusted under 35 U.S.C. 154(b) by 336 days.

(21) Appl. No.: 12/378,782

(22) Filed: Feb. 19, 2009

Related U.S. Application Data

(60) Provisional application No. 61/080,753, filed on Jul. 15, 2008.

(51) Int. Cl.
*A45F 5/00* (2006.01)

(52) U.S. Cl. ..... 294/154; 294/157; 294/165

(58) Field of Classification Search ..... 294/146, 294/147, 149–151, 153–157, 165
See application file for complete search history.

(56) References Cited

U.S. PATENT DOCUMENTS

| | | | | | |
|---|---|---|---|---|---|
| 429,766 | A | * | 6/1890 | Lee | 294/146 |
| 456,433 | A | * | 7/1891 | Rue | 294/138 |
| 471,988 | A | * | 3/1892 | Acheson | 294/154 |
| 4,712,820 | A | * | 12/1987 | Cartledge | 294/138 |
| 5,251,945 | A | * | 10/1993 | Stoops | 294/152 |
| 5,348,362 | A | * | 9/1994 | Rolls | 294/151 |
| 5,352,007 | A | * | 10/1994 | Kirsch | 294/149 |
| 5,409,282 | A | * | 4/1995 | Bale | 294/152 |
| 6,138,882 | A | | 10/2000 | Buettner | |
| 6,371,346 | B1 | | 4/2002 | Sharma | |
| 6,953,214 | B2 | | 10/2005 | Paz | |
| 7,093,324 | B2 | | 8/2006 | Udy | |

* cited by examiner

*Primary Examiner* — Dean J Kramer
(74) *Attorney, Agent, or Firm* — Edward P Dutkiewicz

(57) ABSTRACT

A roll holder comprising a body having a first end and a second end. A handle is coupled to the body of the roll holder by an attachment. A pair of closing straps is attached to the body. A business card holder, coupled to the body, has a clear viewing window therein.

5 Claims, 5 Drawing Sheets

FIG 1
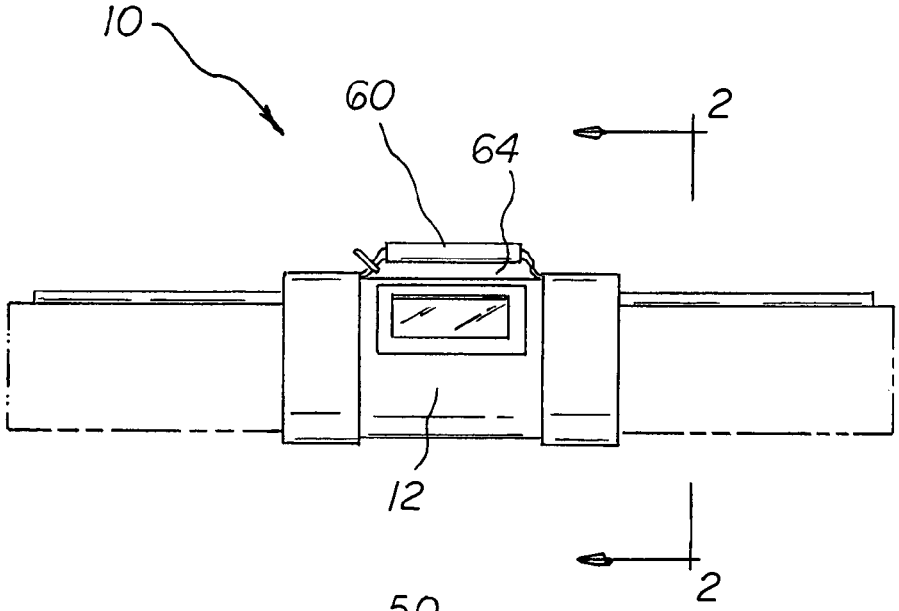
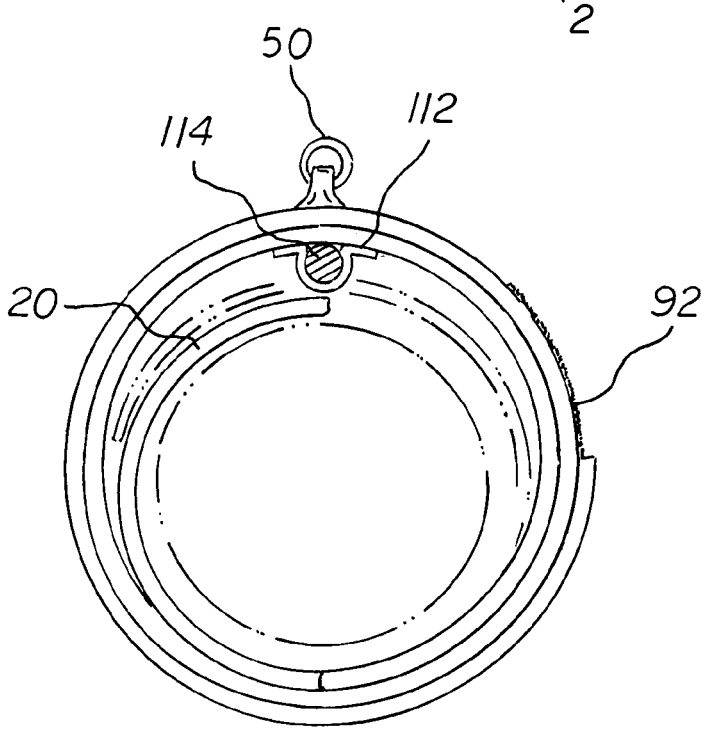
FIG 2

ROLL HOLDER

The present application is a non-provisional application filed after the filing of a provisional application, bearing Ser. No. 61/080,753, filed on Jul. 15, 2008. The present application is based upon the provisional application, which is currently pending, and the applicant claims the benefit and priority of the provisional application.

RULE 1.78(F)(1) DISCLOSURE

The Applicant has not submitted a related pending or patented non-provisional application within two months of the filing date of this present application. The invention is made by a single inventor, so there are no other inventors to be disclosed. This application is not under assignment to any other person or entity at this time.

BACKGROUND OF THE INVENTION

1. Field of the Invention

The present invention relates to a roll holder and more particularly pertains to a device to be used to carry rolled material, such as blueprints.

2. Description of the Prior Art

The use of devices to carry rolled material is known in the prior art. More specifically, devices to carry rolled material previously devised and utilized for the purpose of carrying blueprints, paper charts, and sketch charts are known to consist basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, the aforementioned patents do not describe roll holder that allows a device to be used to carry rolled material, such as blueprints.

In this respect, the roll holder according to the present invention substantially departs from the conventional concepts and designs of the prior art, and in doing so provides an apparatus primarily developed for the purpose of easily and efficiently carrying rolled material, such as blueprints.

Therefore, it can be appreciated that there exists a continuing need for a new and improved roll holder which can be used for a device to be used to carry rolled material, such as blueprints, charts or rolled material, such as cloth. In this regard, the present invention substantially fulfills this need.

SUMMARY OF THE INVENTION

In view of the foregoing disadvantages inherent in the known types of devices to carry rolled material now present in the prior art, the present invention provides an improved roll holder. As such, the general purpose of the present invention, which will be described subsequently in greater detail, is to provide a new and improved roll holder and method which has all the advantages of the prior art and none of the disadvantages.

To attain this, the present invention essentially comprises a a roll holder comprising several components, in combination. The roll holder comprises a body. The body has a first end and a second end. The body has a generally rectilinear configuration with an upper surface and a lower surface with a thickness there between.

The body has a pair of receiving areas adjacent each of the side edges. The receiving areas form a location for the attachment of a pair of closing straps. The first end of the body having a generally rectilinear tongue portion. The tongue portion of the body has a free end, a pair of generally parallel side edges, and an attachment end. The second end of the body has a recess therein.

The attachment end of the tongue is continuous with the body of the Roll holder. The attachment end of the tongue is located opposite of the free end of the tongue. The body recess is located between the side edges of the body. The recess is continuous between the side edges of the body. The recess of the body has a generally C-shaped configuration.

The body is fabricated of a generally flexible material. A synthetic or natural material may be used. Such material may be nylon or cotton, or blends of either synthetic and natural materials, or blends of only synthetic materials and blends of only natural materials. The body has a pair of generally parallel side edges located between the first end and the second end. The side edges are each continuous between the first end of the body and the second end of the body. The body receiving areas are located generally parallel to each other.

The second component of the Roll holder is the handle. The handle has a first end and a second end. The handle is coupled to the body of the Roll holder by an attachment. Examples of attachments are D rings, loops, hooks, straps, mechanical fasteners, pins and loops, clamps, bolts, screws, wires and ties. Mechanical fasteners may be brackets which have a mounting portion, for joining the fastener to a surface, and a coupler, for connecting the bracket to the handle. Such a mechanical fastener is well known in the luggage industry, and is commonly employed.

The handle has an upper surface and lower surface with a thickness there between.

The handle is coupled to the body of the roll holder at the first end of the handle and at the second end of the handle, thereby forming a passageway for a user's hand there through in the space between the handle and the body of the roll holder.

The first end of the handle and the second end of the handle each terminate with a loop. The loop forms a way of coupling each of the ends of the handle to the attachment. Such attachment may be made by wire or a pin, as is commonly employed in the luggage industry.

The third component of the Roll holder is a pair of closing straps. Each of the closing straps has an upper surface and a lower surface, with a thickness there between. Each of the straps has a first end and a second end.

Each of the straps has a midpoint. The midpoint is located generally equidistant from the first end of the strap and the second end of the strap.

The pair of closing straps comprises two similarly-configured closing straps, with each of the straps being oriented generally parallel with each other. Each of the straps has a hook area portion. The hook area portion is located on the upper surface of each of the straps. Each of the straps has a loop area portion. The loop area portion is located on the lower surface of each of the straps.

The loop area portion of each of the straps extends from the second end of each of the straps to about the midpoint of each of the straps.

The loop area portion is coupled to the strap by a stitch. The hook area portion of each strap extends from the first end of the strap to about the midpoint of the strap.

The hook area portion of each of the straps is coupled to the first end of the strap by a stitch, with the first end of the strap being coupled to the body by a stitch.

Each of the straps is coupled to the body of the roll holder in the location of the receiving areas of the body. The lower surface of the first end of the strap is in contact with the upper surface of the body, with the second end of the strap then being free.

Lastly, the roll holder comprises a business card holder. The business card holder has a generally rectilinear configuration with an outer surface and an inner surface. The business card holder has a first side edge and a second side edge. The holder has a top edge and bottom edge, with the top edge and the bottom edge being generally parallel with each other. The first side edge and second side edge of the business card holder are oriented to be generally parallel with each other. the card holder is coupled to the body of the Roll holder by a stitch running from the first side edge across the top edge of the card holder and across the second side edge of the card holder, with the bottom edge of the card holder being free. The card holder has a clear viewing window therein.

The inner surface of the business card holder is adjacent the upper surface of the body of the roll holder, forming a recess there between. The free bottom edge thereby allows the placement of a business card within the recess between the body and the inner surface of the card holder.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved roll holder which has all of the advantages of the prior art devices to carry rolled material, and none of the disadvantages.

It is another object of the present invention to provide a new and improved roll holder which may be easily and efficiently manufactured and marketed.

It is further object of the present invention to provide a new and improved roll holder which is of durable and reliable constructions.

An even further object of the present invention is to provide a new and improved roll holder which is susceptible of a low cost of manufacture with regard to both materials and labor, and which accordingly is then susceptible of low prices of sale to the consuming public, thereby making such roll holder economically available to the buying public.

Even still another object of the present invention is to provide a roll holder for a device to be used to carry rolled material, such as blueprints.

Lastly, it is an object of the present invention to provide a new and improved roll holder comprising a body having a first end and a second end. The roll holder has a handle having a first end and a second end with a length there between. The handle is coupled to the body of the roll holder by an attachment. There is a pair of closing straps. Each of the closing straps has an upper surface and a lower surface with a thickness there between. Each of the straps having a first end and a second end with a length there between. Lastly, there is a business card holder having a clear viewing window therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevation of the invention

FIG. 2 is a view taken along line 2-2 of FIG. 1.

The same reference numerals refer to the same parts throughout the various Figures.

DESCRIPTION OF THE PREFERRED EMBODIMENT

Figure 3:
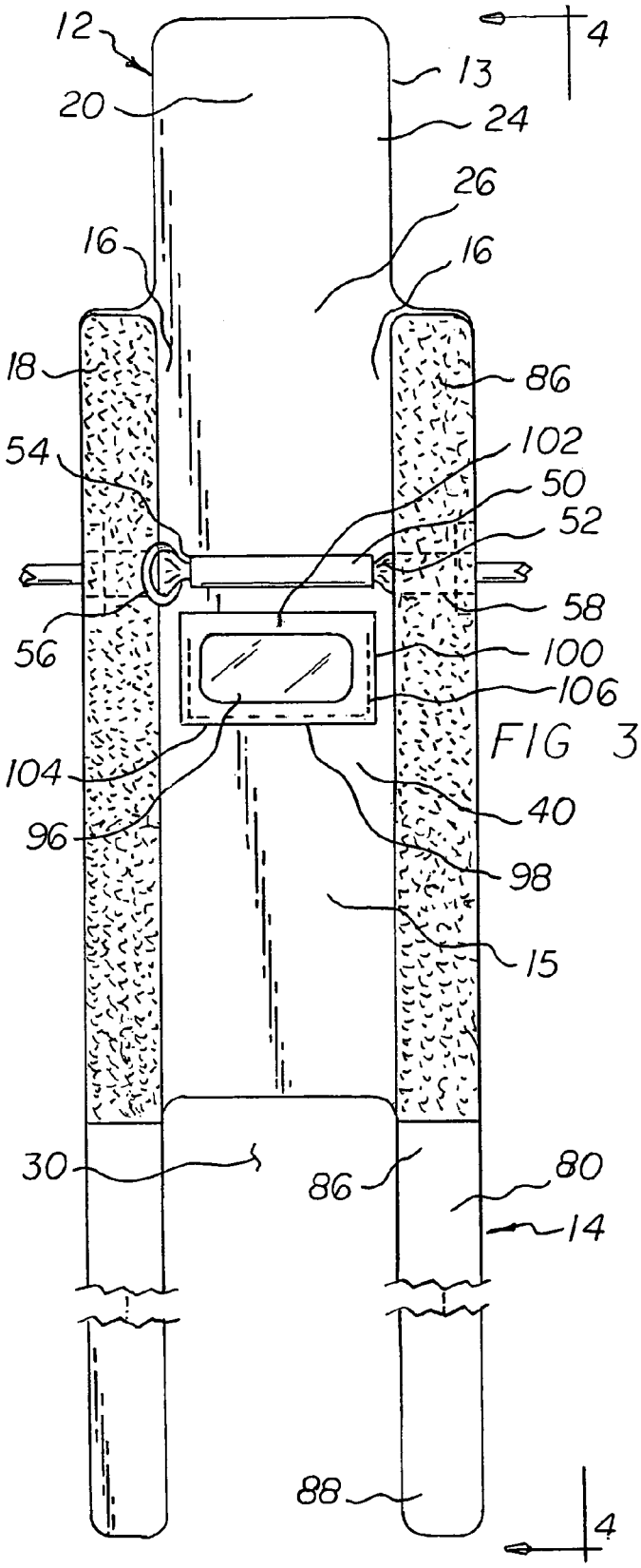
FIG. 3 is a top plan view showing the device opened.
Figure 4:
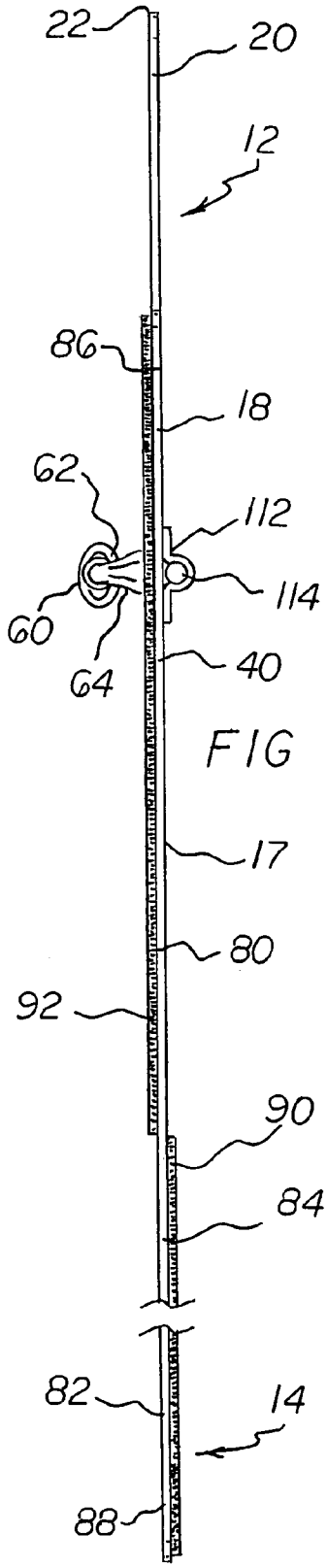
FIG. 4 is a view taken along line 4-4 of FIG. 3.
Figure 5:
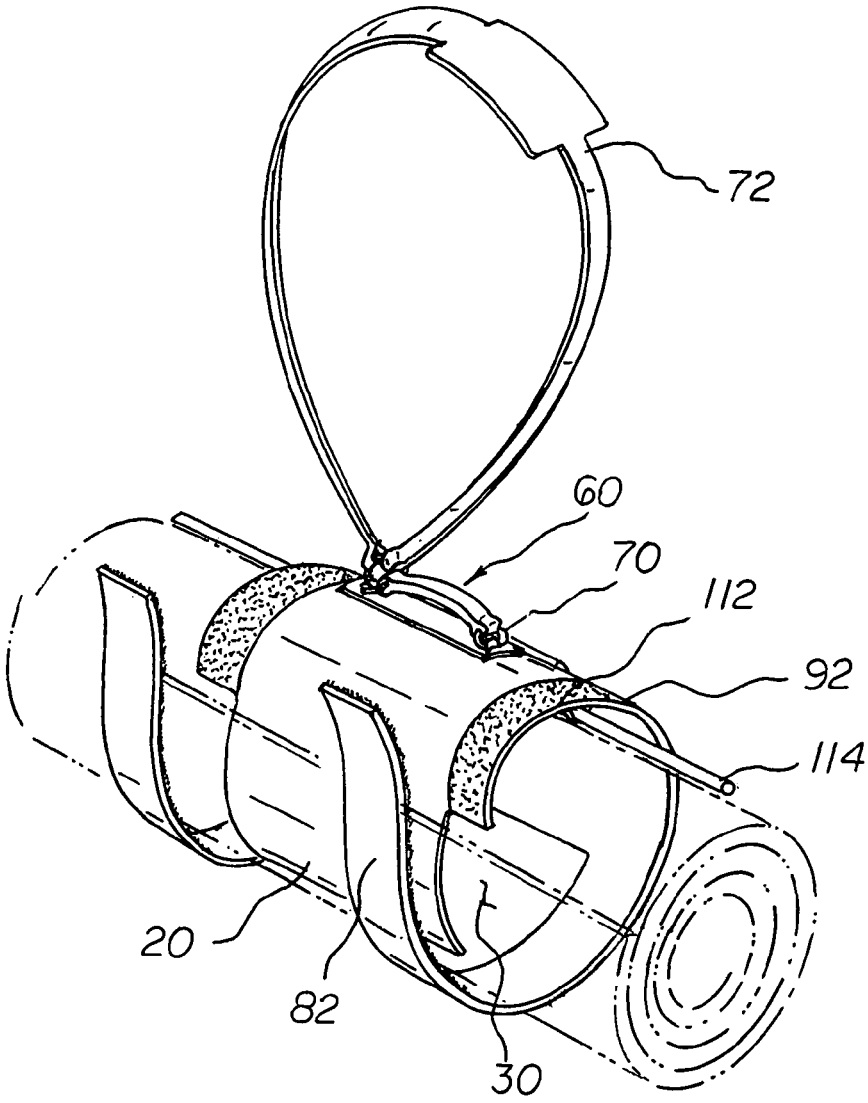
FIG. 5 is a perspective view of the invention with a shoulder strap. Note that the tongue of the device is located within the pages of the document which is contained within the roll holder.
Figure 6:
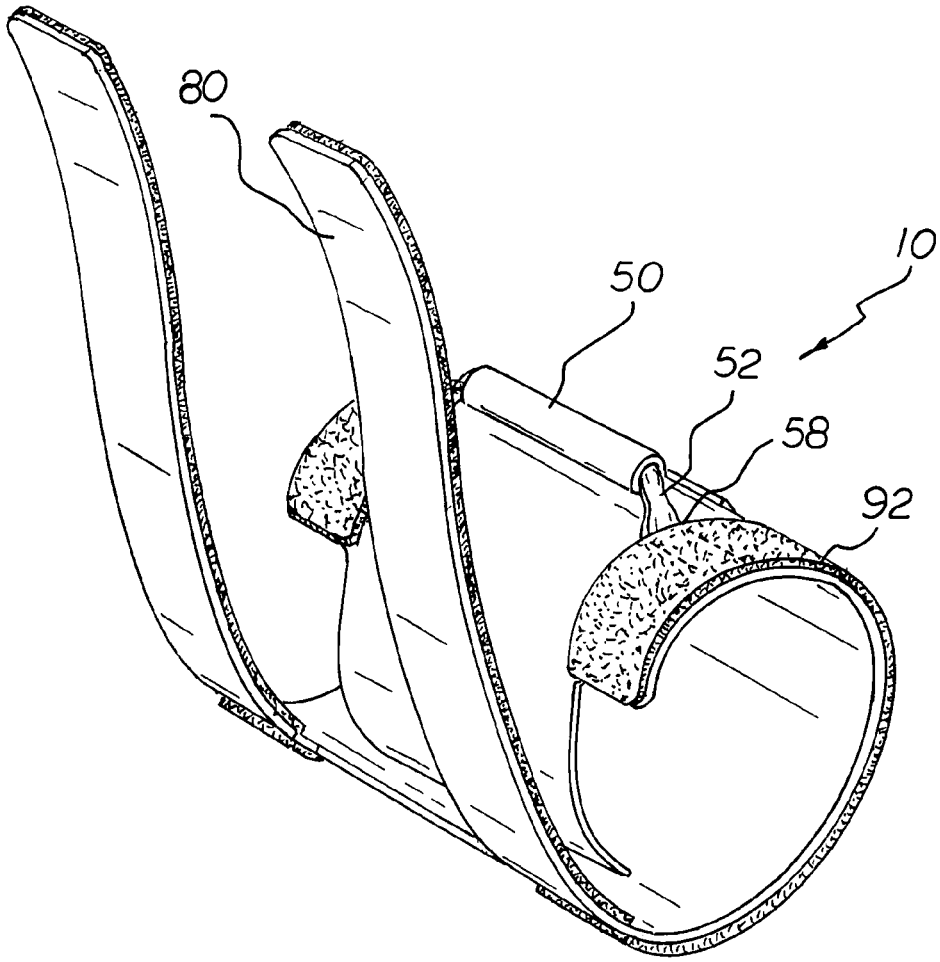
FIG. 6 is a perspective view of the device without a rolled document within the roll holder.
Figure 7:
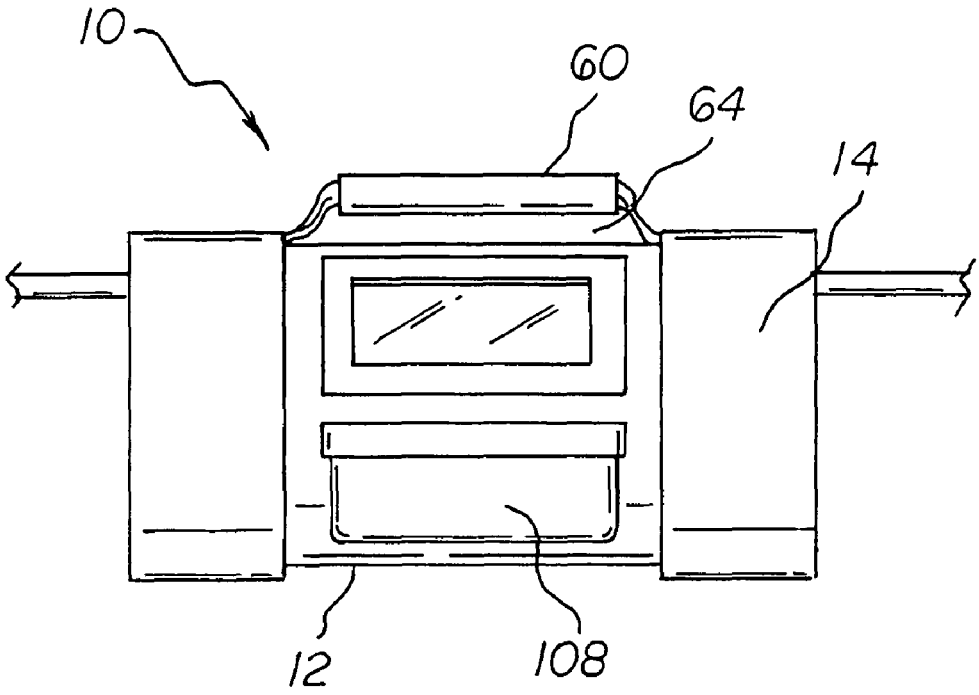
FIG. 7 is a side elevation view of the invention showing a container attached to the roll holder body.

With reference now to the drawings, and in particular to FIG. 1 thereof, the preferred embodiment of the new and improved roll holder embodying the principles and concepts of the present invention and generally designated by the reference numeral 10 will be described.

The present invention, the roll holder 10 is comprised of a plurality of components, in combination. Such components in their broadest context include a body, a pair of straps, a handle and a business card holder. Such components are individually configured and correlated with respect to each other so as to attain the desired objective.

The roll holder, so constructed, allows a user to carry rolled material, such as blueprints, exhibits, and magazines. Any rolled material can be carried with this device.

The roll holder comprises a body 12. The body has a first end 13 and a second end 14. The body has a generally rectilinear configuration with an upper surface 15 and a lower surface 17 with a thickness there between.

The body has a pair of receiving areas 16 adjacent each of the side edges. The receiving areas form a location for the attachment of a pair of closing straps 18. The first end of the body having a generally rectilinear tongue portion 20. The tongue portion of the body has a free end 22, a pair of generally parallel side edges 24, and an attachment end 26. The second end of the body has a recess therein.

There are other roll holders in the prior art, however, the tongue portion of the present invention is an improvement, and the tongue keeps the rolled material from slipping from the grip of the roll holder. This is done by the tongue being rolled within the pages of the rolled document, such as a blueprint. The pages must be positioned so that the tongue may be placed between some of the pages of the document before it is then rolled up, and wrapped with the present device.

The attachment end of the tongue is continuous with the body of the roll holder, though in alternate embodiments, the tongue may be detachable, or removable, so that the tongue may be varied with the type of document carried, or the need to incorporate the tongue into the pages to prevent slipping of the document within the roll holder.

The attachment end of the tongue is located opposite of the free end of the tongue. The body recess 30 is located between the side edges of the body. The recess is continuous between the side edges of the body. The recess of the body has a generally C-shaped configuration.

The body is fabricated of a generally flexible material. A synthetic or natural material may be used for fabrication. Such material may be nylon or cotton, or blends of either synthetic and natural materials, or blends of only synthetic materials and blends of only natural materials. In general, any flexible material may be used.

The body has a pair of generally parallel side edges 40 located between the first end and the second end. The side edges are each continuous between the first end of the body and the second end of the body. The body receiving areas are located generally parallel to each other adjacent the side edges.

The second component of the roll holder is the handle 50. The handle has a first end 52 and a second end 54. The handle is coupled to the body of the roll holder by an attachment. Examples of attachments are "D" rings 56, loops, hooks, straps, mechanical fasteners, pins and loops, clamps, bolts, screws, wires, titabs and stitching 58, and ties. Mechanical fasteners may be brackets which have a mounting portion, for joining the fastener to a surface, and a coupler, for connecting the bracket to the handle. Such a mechanical fastener is well known in the luggage industry, and is commonly employed.

The handle has an upper surface 60 and lower surface 62 with a thickness there between.

The handle is coupled to the body of the roll holder at the first end of the handle and at the second end of the handle, thereby forming a passageway 64 for a user's hand there through in the space between the handle and the body of the roll holder.

In another embodiment, the first end of the handle and the second end of the handle each terminate with a loop 70. The loop forms a way of coupling each of the ends of the handle to the attachment. Such attachment may be made by wire or a pin, as is commonly employed in the luggage industry.

In another embodiment, the handle may be augmented by a D ring, so as to allow the addition of a shoulder strap 72. Such a configuration would allow a user to carry the roll holder over his or her shoulder, freeing their hands to carry out other tasks, such as opening doors.

The third component of the roll holder is a pair of closing straps 80. Each of the closing straps has an upper surface 82 and a lower surface 84, with a thickness there between. Each of the straps has a first end 86 and a second end 88 with a first length there between.

Each of the straps has a midpoint. The midpoint is located generally equidistant from the first end of the strap and the second end of the strap.

The pair of closing straps comprises two similarly-configured closing straps, with each of the straps being oriented on the roll holder body generally parallel with each other. Each of the straps has a hook area portion 90. The hook area portion is located on the lower surface of each of the straps. Each of the straps has a loop area portion 92. The loop area portion is located on the upper surface of each of the straps.

The loop area portion of each of the straps extends from the second end of each of the straps to about the midpoint of each of the straps. The loop area portion is coupled to the strap by a stitch (not shown, but well known in the art).

The hook area portion of each strap extends from the first end of the strap to about the midpoint of the strap. The hook area portion of each of the straps is coupled to the first end of the strap by a stitch, with the first end of the strap being coupled to the body by a stitch (also not shown, but well known in the art).

Each of the straps is coupled to the body of the roll holder in the location of the receiving areas of the body. The first end of the strap is in contact with the body, with the second end of the strap then being free.

Other forms of coupling the roll holder around a rolled material may be used. Such a means of connection, whereby the body may be wrapped and secured around a roll-able material, may comprise ties, straps, bands, and elastomeric materials. The straps may be coupled to encircle the rolled material by use of buckles, snaps, clips, wires, strings, ties, hooks, and loops.

Lastly, the roll holder comprises a business card holder 96. The business card holder has a generally rectilinear configuration with an outer surface and an inner surface. The business card holder has a first side edge 98 having a second length and a second side edge 100 also having a second length. The holder has a top edge 102 having a third length and bottom edge 104 also having a third length, with the top edge and the bottom edge being generally parallel with each other. The first side edge and second side edge of the business card holder are oriented to be generally parallel with each other. The business card holder, in other embodiments may have any configuration, such as a circle, square, triangle or random shape.

The card holder is coupled to the body of the roll holder by a stitch 106 running from the first side edge across the bottom edge of the card holder and across the second side edge of the card holder, with the top edge of the card holder being free. The card holder has a clear viewing window therein.

The inner surface of the business card holder is adjacent the upper surface of the body of the roll holder, forming a recess there between. The free top edge thereby allows the placement of a business card within the recess between the body and the inner surface of the card holder.

In an alternate embodiment, the roll holder body may also comprise at least one compartment 108, with the compartment being coupled by an attachment means, such as stitching, adhesives, rivets, screws, bolts, snaps, clips, wires or ties. There is a pocket 112, also referred to as a pouch, may have an associated rod 114. The rod is used to provide rigidity to the roll holder. In this configuration the rod is inserted into the pouch. The pouch is sewn along the lower surface of the body of the roll holder.

In other embodiments, the rod holder may be inserted through a pocket, along the fold of the printed matter, such as blueprints, and into another pocket, thereby locking the blueprint into the roll holder. In this configuration the roll holder may be used to hang the blueprints in a flattened configuration. When needed, the roll holder may be taken from the hanging structure, such as a hook, and then rolled about the blueprints, for easy transport and/or display.

In still other forms of the invention, indicia (not shown, but well known in the art), such as lettering or numbering may be inscribed or embossed on the upper surface of the roll holder. This embossment will allow for company logos, or other distinctive markings to be used on the surface of the roll holder. In addition to embossing, embroidery may be used to mark the roll holder with indicia.

When referred to, a "means of connection" may be hook and loop fasteners, adhesives, buckles, buttons, clips, pins, wires, ties, stitching, snaps, and rivets.

The primary object of the present invention is to provide a manner in which the user of the present invention may transport large sheets of roll-able material, with the preferred embodiment of the invention being used to transport large rolled sheets of blueprints, in an easily handled fashion. Another object of this invention is to allow for the transport of the roll-able materials in a neat, organized, and protected environment. An additional object of the invention is to provide a device which will be able to hold and store the roll-able materials when they are not in use.

The above objects are achieved by the present invention which has a body made of various types of fabric, two or more means of connection for when the body is wrapped and secured around the roll-able materials, a handle for the user to hold and carry the device, as well as a small business card sized holder attached to the body of the device.

In the typical embodiment of the present invention, the device is made up of the follow elements: (1) a body made from various types of fabric, which may be flexible and strong enough to wrap around and hold whichever roll-able material the user plans to carry; (2) two or more means by which the body of the device is secured and held in a wrapped state when place around the roll-able materials; (3) a handle by which the user may carry and hold the invention; and (4) a small business sized card holder attached to eh body of the invention. These elements are connected as follows, the body has a connection means placed on each side of the body, the handle is attached across the body and the business cared sized holder is coupled to the body.

Further, the invention, in other embodiments, may have (1) pockets, or pouches, which are attached to the body for holding various accessories; (2) hooks and straps, where the hooks are attached to the body on each end so as to allow for a strap to be attached to the hooks and hung from the shoulder of the user, keeping the user's hands free; (3) a rod, which may be inserted into the pouch or pocket, sewn along the body, in order to provide extra support in larger sized roll holders; and (4) embossed or embroidered lettering, or indicia, which is placed in an area adjacent to business card holder, so as to provide an area where a company name or logo may be displayed on the body of the device.

It is to be further noted that the body of the device can be fabricated of a wide variety of materials, such as, but not limited to, leather, cotton, canvas, vinyl and recyclable materials, such as plastic and natural materials, such as hemp. The materials used to make the preferred embodiment are leather and canvas.

A connection means may be a single means, or it may be two or more means of connection. A connection means may comprise a variety of connection means, such as, but not limited to, heavy duty hook and loop strips, a set of adhesive surfaces, one or more of the various kinds of belt buckles, or buttons, with the preferred embodiment of the invention utilizing heavy duty hook and loop strips, which may be attached to the body of the present invention through various means, such as, but not limited to, the user of various adhesives or heat, or by being sewn into place with various types of thread, such as, but not limited to, nylon, cotton, or canvas, with nylon threads being preferred.

The handle may be made of various materials such as, but not limited to, leather, cotton, canvas, vinyl, plastic or other sufficiently resilient material, but leather encased in plastic is preferable. The business cared holder can be made ov various materials such as, but not limited to, leather, cotton, canvas, hemp, vinyl, but leather is preferred with its attachment to the body being achieved through the use of a variety of means, such as, but not limited to, the use of various adhesives or by being sewn on or heated into place.

The pockets, which may be attached on the body for carrying small accessories, can be made from various materials, such as, but not limited to, leather, cotton, canvas, hemp, plastic, vinyl and can also be attached by various means such as, but not limited to, the use of adhesives, heat treated in place or sewn on, with a variety of thread material.

The hooks can be made of various metal alloys or any other material sufficiently resilient to include, but not limited to, stainless steel, or hard plastic, copper, brass, aluminum. The carrying strap may be made form the same, but not limited to, materials used to made the body or the handle. The rod for support can be made of various materials such as, but not limited to, plastic, wood, or metal.

The method of using a roll holder, as herein described, to carry a multi-paged document comprises the following steps. First the user opens the roll holder and lays it flat on a recipient surface. A multi-paged document is then placed within the opened roll holder. The roll holder has a body comprising a tongue and pair of straps, as herein described.

The user then rolls the document so that the tongue of the roll holder is oriented so as to be able to be placed between at least two pages of the document. The roll holder is then rolled around the document while keeping the tongue between the document pages. As the roll holder is tightly wrapped around the document, the pressure of the roll holder on the document exerts pressure through the document, causing the document to be tight against the tongue of the body of the roll holder. Once wrapping is complete, the roll holder is then secured around the rolled document by securing the body straps using the hook and loop fasteners coupled thereto.

In another variation of the method, the user may employ the holder to carry a multi-paged document in a manner in which the document is fixed to the roll holder. In this variation the method further comprises the multi-paged document being a bound document having a binding. Such a document may be a blueprint or a multi-paged plan. The body of the holder has an associated rod. The rod is inserted between at least two pages of the document, adjacent the binding of the document, before the document is rolled. In this configuration the rod is coupled to the body of the roll holder by a pouch before the document is rolled. The document is rolled and the roll holder is then rolled around the document. In this configuration, the roll holder may be loosened, and the document is then suspended from the rod. The roll holder may then be placed on a hanger for storage, allowing the pages of the document to hang straight. This manner of storage would make accessibility to the prints or document convenient and efficient.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A roll holder comprising, in combination, a body, a means of connection whereby the body may be wrapped and secured around a roll-able material, a handle, and a business card holder, wherein the means of connection is attached by an attachment means to both edges of the body, the handle is attached by an attachment means across an upper surface of the body; and the business card holder is attached by an attachment means to the body in an area adjacent the handle, with the roll holder having at least one pocket, at least one hook and at least one strap, a rod and indicia, wherein the pocket is attached to an upper surface of the body by an attachment means, the hook being attached by an attachment means to the upper surface of the body, with the strap attached to the hooks, the rod being inserted into a pouch sewn along the upper surface of the body, and the indicia being located adjacent the business card holder on the upper surface of body.

2. A roll holder comprising, in combination:

a body having a first end and a second end;

a handle having a first end and a second end, with the handle being coupled to the body of the roll holder by an attachment;

a pair of closing straps, with each of the closing straps having an upper surface and a lower surface with a thickness there between, each of the straps having a first end and a second end;

a business card holder having a clear viewing window therein;

the body having a generally rectilinear configuration with an upper surface and a lower surface with a thickness there between, the body having a pair of receiving areas adjacent each of the side edges for attachment of the pair of closing straps, the first end of the body having a generally rectilinear tongue portion;

the handle having an upper surface and lower surface with a thickness there between;

each of the straps having a midpoint, the midpoint being located generally equidistant from the first end of the strap and the second end of the strap; and the business card holder having a generally rectilinear configuration with an outer surface and an inner surface;

the body being fabricated of a generally flexible material, with the body having a pair of generally parallel side edges located between the first end and the second end, with the side edges being continuous between the first end and the second end, the body receiving areas being generally parallel to each other;

the first end of the handle and the second end of the handle each terminating with a loop for coupling each of the ends of the handle to the attachment;

the closing straps comprising two similarly-configured closing straps with each of the straps being generally parallel with each other, each of the straps having a hook area portion being located on the upper surface of the strap, each of the straps has a loop area portion on the lower surface of the strap; and the business card holder having a first side edge and a second side edge, the holder having a top edge and bottom edge with the top edge and the bottom edge being generally parallel with each other.

3. The roll holder as described in claim 2 with the roll holder further comprising:

the tongue portion of the body having a free end and a pair of generally parallel side edges and an attachment end, the second end of the body having a recess therein;

the handle being coupled to the body of the roll holder at the first end of the handle and at the second end of the handle;

with the loop area portion of each of the straps extending from the second end of each of the straps to about the midpoint of each of the straps; and the first and second side edges of the business card holder being generally parallel with each other.

4. The roll holder as described in claim 3 with the roll holder further comprising:

the attachment end of the tongue being continuous with the body of the roll holder and located opposite of the free end of the tongue, the recess being located between the side edges, and being continuous between the side edges of the body;

the loop area portion being coupled to the strap by a stitch with the hook area portion of each strap extending from the first end of the strap to about the midpoint of the strap;

with each of the straps being coupled to the body of the roll holder in the location of the receiving areas of the body, with each strap being coupled to the body of the roll holder so that the lower surface of the first end of the strap is in contact with the upper surface of the body, with the second end of the strap then being free; and the card holder being coupled to the body of the roll holder by a stitch running from the first side edge across the top edge of the card holder and across the second side edge of the card holder, with the bottom edge of the card holder being free.

5. The roll holder as described in claim 3 with the roll holder further comprising:

the recess of the body having a generally C-shaped configuration;

the hook area portion being coupled to the first end of the strap by a stitch, with the first end of the strap being coupled to the body by a stitch; and the inner surface of the business card holder being adjacent the upper surface of the body of the roll holder, forming a recess there between, the free bottom edge thereby allowing the placement of a business card within the recess between the body and the inner surface of the card holder.

* * * * *